US006513591B1

(12) United States Patent
Heijnen

(10) Patent No.: US 6,513,591 B1
(45) Date of Patent: Feb. 4, 2003

(54) LEAK DETECTION METHOD

(75) Inventor: Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 58 days.

(21) Appl. No.: 09/724,081

(22) Filed: Nov. 28, 2000

(30) Foreign Application Priority Data

Nov. 30, 1999 (EP) ..... 99309606

(51) Int. Cl.[7] ..... E21B 47/10; E21B 47/14

(52) U.S. Cl. ..... 166/250.08; 367/35; 73/152.57; 181/105

(58) Field of Search ..... 166/73, 337, 113, 166/250.08; 367/35; 73/152.57; 181/105

(56) References Cited

U.S. PATENT DOCUMENTS 2,361,458 A 10/1944 Converse ..... 177/311
4,525,815 A * 7/1985 Watson ..... 181/106
4,744,416 A 5/1988 Bower ..... 166/253
4,928,269 A * 5/1990 Kimball et al. ..... 181/105
5,031,467 A 7/1991 Rambow ..... 73/861.25
5,072,388 A * 12/1991 O'Sullivan et al. ..... 181/105
5,353,873 A * 10/1994 Cooke, Jr. ..... 166/64
5,874,676 A * 2/1999 Maki, Jr. ..... 181/105

* cited by examiner

*Primary Examiner*—David Bagnell
*Assistant Examiner*—Daniel P Stephenson

(57) ABSTRACT

A method for detecting a leak in a well tubular of a well for production of hydrocarbon fluid from a formation is disclosed. The method includes steps of: passing a sonic tool provided with a transducer package capable of sending and receiving a sonic signal through the well tubular; prior to starting production to obtain an initial registration of a reflected signal for a well that does not have a leak; obtaining at least one subsequent registrations of reflected signals; comparing the initial registration to a subsequent registration and determining from the differences between the two if a leak has developed in the well tuburtar.

3 Claims, 1 Drawing Sheet

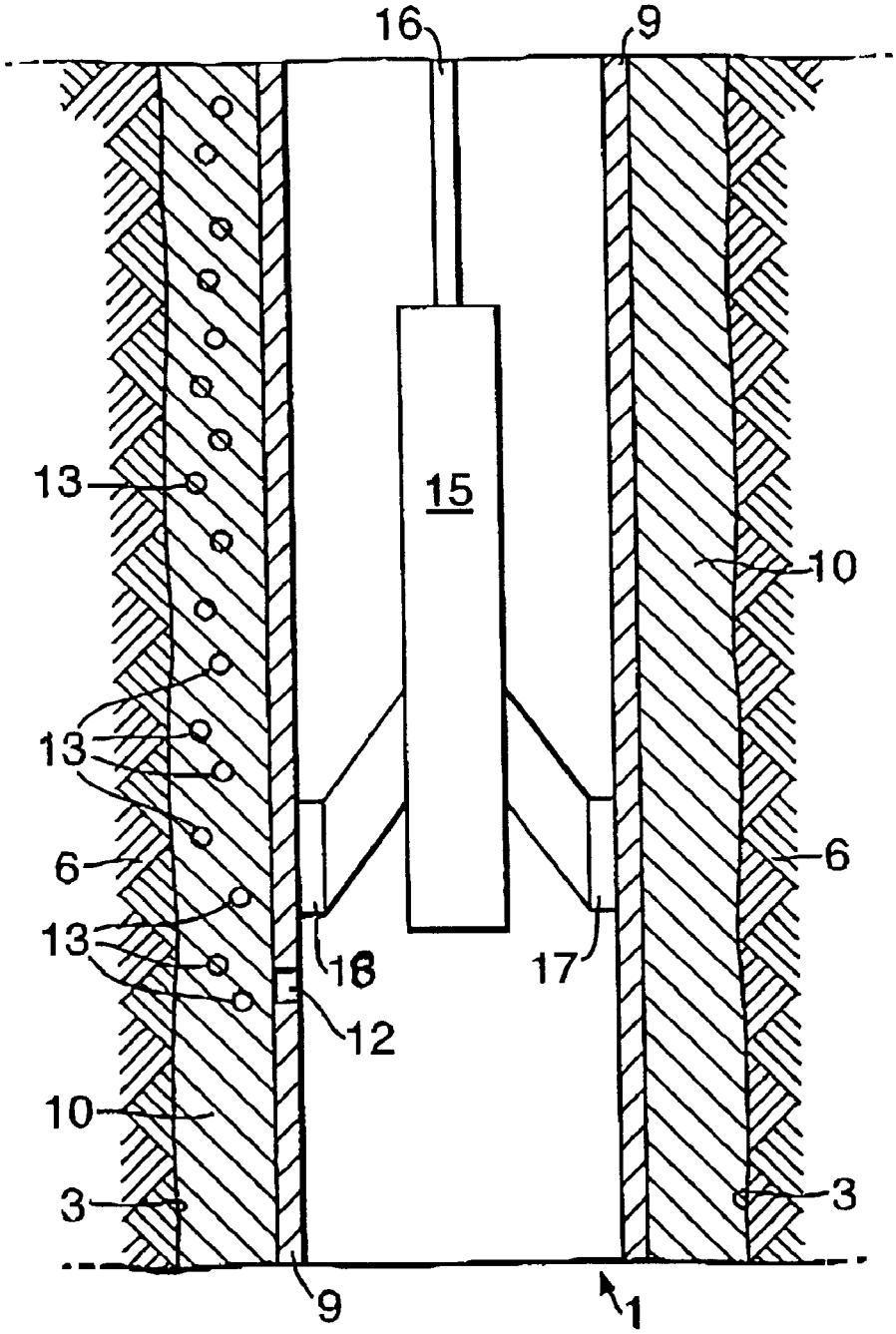
16
9
13
15
10
13
6
6
13
18
17
12
10
3
3
9
1

LEAK DETECTION METHOD

FIELD OF THE INVENTION

The present invention relates to a method of detecting a leak in a well tubular of a well. The well comprises a borehole lined with a well tubular that is cemented into the borehole. The well can be a fluid-producing well or an injecting well.

BACKGROUND OF THE INVENTION

It is often difficult to detect the presence of a leak in the well tubular, and it is even more difficult to determine the location of such a leak.

It is an object of the present invention to provide a simple method to overcome this problem.

SUMMARY OF THE INVENTION

In accordance with the invention there is provided a method of detecting a leak in a well tubular of a well for the production of hydrocarbon fluid from an earth formation, the method comprising the steps of:

a) passing a sonic tool provided with a transducer package capable of sending an receiving a sonic signal, through the well tubular;

b) prior to start of hydrocarbon fluid production through the well, inducing the transducer package to transmit the sonic signal through the well tubular and to receive a reflected signal, and making a primary registration of the reflected signal indicative of a leak-free well tubular;

c) after start of hydrocarbon fluid production through the well, inducing the transducer package to transmit the sonic signal through the well tubular and to receive a reflected signal, and making a secondary registration of the reflected signal indicative of an operational well tubular;

d) comparing the primary and secondary registrations and detecting a leak in the well tubular from a difference between said registrations.

It is thus achieved that the primary registration serves as a reference which represents the situation of no leakage of fluids through the tubular. Any difference between the later registration and the reference provides an indication of the occurrence leakage through the well tubular.

Reference is made to U.S. Pat. No. 5,031,467. This publication discloses a method of detecting fluid flow behind the casing that can be used in the method of the present invention. Suitably, the transducer package is packed in set of pads which are in contact with the inner surface of the well tubular.

BRIEF DESCRIPTION OF THE INVENTION

FIG. 1 is a schematic cross-sectional view of a sensor in a wellbore according to an embodiment of the present invention.

DESCRIPTION OF AN EMBODIMENT OF THE INVENTION

The invention will now be described in more detail with reference to the accompanying drawing, which shows schematically a cross-section of part of a well 1, which can be a production or an injection well. The well 1 comprises a borehole 3 drilled into an underground formation 6. The borehole 3 is lined with a well tubular in the form of casing or a liner 9, and the annular space between the outer surface of the casing 9 and the inner surface of the borehole 3 is filled with cement 10.

During normal operation, fluid is transported through the casing 9 to surface (not shown) in case of a production well, or to an underground location (not shown) in case of an injection well. When there is a leak in the casing 9, fluid will escape into the cement-filled annular space 10. Because the cement is porous, fluid will migrate through the cement 10. In the drawing, the leak in the casing 9 is referred to by means of reference numeral 12, and the migrating fluid is shown as bubbles 13. For the sake of clarity, not all bubbles have been referred to with a reference numeral.

In order to detect the presence of a leak in the casing 9, a sonic tool 15 suspended from a cable or a pipe 16 is lowered into the casing 9. The sonic tool 15 comprises two or more pads containing each a transducer package shown as numeral 17 and 18, which pads are during normal operation in contact with the inner surface of the well tubular 9. The transducer packages 17, 18 comprise separate transmitting and receiving transducers (not shown). During normal operation the transmitter transducers generate a high-frequency pulsed beam of acoustic energy and the reflections are received by the receiving transducers. Differences between a pair of received reflections will be an indication of fluid flow behind the well tubular 9 (assuming no other changes). The sonic tool 15 is electronically connected by means of an electrical cable to the read-out unit at surface (not shown) to make a registration of the signals from the transducer packages 17 and 18 allowing interpretation of the signals at surface. The registration of the received signals forms an acoustic signature of the well tubular, and it can be used to detect fluid flow behind the well tubular 9.

The fluid 13 migrating through the cement 10 will be detected by the transducer packages as described in U.S. Pat. No. 5,031,467. When having installed and cemented the casing 9 the sonic tool 15 is run and operated to make a registration indicative of a leak-free well tubular, and it is kept for future reference so that there is no misinterpretation in the later life time of the well. The registration is an acoustic signature of a leak-free well tubular. Subsequent runs are made during the life time of the well to detect possible flow behind the well tubular 9 due to cross-flow between two earth formations. Together with other registrations it can be used to determine whether there is cross-flow and how this develops.

Whenever the sonic tool 15 is being run later it will be run in the following manner. The sonic tool 15 is lowered to the bottom of wellbore 1 and the pads 17 and 18 are then brought into contact with the inside of the casing 9. The sonic tool 15 is then pulled up and whenever it passes a position were a leak in the casing 9 has developed the read-out at surface will detect leakage of well fluids into the cement 10. The position of the leak is then the position of the sonic tool 15 at the time a leak was detected. The registration so obtained is an acoustic signature of a leaking well tubular.

It is not always the case that production is done through the casing 9: in many cases, production takes place through a well tubular in the from of a well tubing that is suspended into the well from surface to the fluid-bearing formation. The annular space between the outer surface of the well tubing and the inner surface of the casing is filled with a liquid (either a drilling mud or a completion fluid). During normal operation, fluid is produced from the fluid-bearing formation. The fluid is transported through the well tubing to surface. When there is a leak in the well tubing, fluid will escape into the liquid in the annular space between the well tubing and the casing, and fluid will thereby migrate through the annular fluid. In order to determine whether there is a leak in the well tubing, a sonic tool as described above is lowered into the well tubing. At surface a registration is made of the signals received from the sonic transducer of the sonic tool and the registrations are compared with a registration indicative of a leak-free well tubular so as to detect the presence of a leak. The location of the leak is then the depth along the borehole of the sonic logging tool.

Alternatively, at regular time intervals the sonic tool is run into the fluid-producing well, and each time the registration is compared with a previous registration. The registration indicative of a leak-free well tubular then is the previous registration.

The invention has been described with reference to fluid leaking out of the interior of the well tubular into the space behind it, however, the method of the present invention can as well be applied in case the fluid leaks from outside the well tubular into it.

The method of the present invention can also be used to determine the quality the cement bond between well tubular and cement, and for determining the movement of earth formations.

The invention provides a simple method of detecting leaks in a fluid-producing well, wherein a sonic tool is used in an active mode.

What is claimed is:

1. A method of detecting a leak in a well tubular of a well for the production of hydrocarbon fluid from an earth formation, the method comprising the steps of:

a) passing a sonic tool provided with a transducer package capable of sending an receiving a sonic signal, through the well tubular;

b) prior to start of hydrocarbon fluid production through the well, inducing the transducer package to transmit the sonic signal through the well tubular and to receive a reflected signal, and making a primary registration of the reflected signal indicative of a leak-free well tubular;

c) after start of hydrocarbon fluid production through the well, inducing the transducer package to transmit the sonic signal through the well tubular and to receive a reflected signal, and making a secondary registration of the reflected signal indicative of an operational well tubular;

d) comparing the primary and secondary registrations and detecting a leak in the well tubular from a difference between said registrations.

2. The method of claim 1, further comprising repeating steps c) and d) at selected time intervals.

3. The method of claim 2, further comprising locating the position of the leak.

* * * * *